US010747178B2

(12) United States Patent
Shibuya et al.

(10) Patent No.: US 10,747,178 B2
(45) Date of Patent: Aug. 18, 2020

(54) MECHANICAL COMPONENT AND TIMEPIECE

(71) Applicant: Seiko Epson Corporation, Tokyo (JP)

(72) Inventors: Munehiro Shibuya, Minamiminowa (JP); Takeo Funakawa, Chino (JP); Eiichi Nagasaka, Minowa (JP)

(73) Assignee: Seiko Epson Corporation (JP)

( * ) Notice: Subject to any disclaimer, the term of this patent is extended or adjusted under 35 U.S.C. 154(b) by 212 days.

(21) Appl. No.: 15/962,433

(22) Filed: Apr. 25, 2018

(65) Prior Publication Data

US 2018/0314208 A1 Nov. 1, 2018

(30) Foreign Application Priority Data

Apr. 28, 2017 (JP) ..... 2017-089387

(51) Int. Cl.
*G04B 15/14* (2006.01)
*G04B 13/02* (2006.01)

(52) U.S. Cl.
CPC ..... *G04B 15/14* (2013.01); *G04B 13/02* (2013.01); *G04B 13/022* (2013.01); *G04B 13/025* (2013.01)

(58) Field of Classification Search
CPC ..... G04B 1/16; G04B 13/022; G04B 13/025; G04B 15/14; G04B 13/026; G04B 13/02; G04B 13/021; G04B 13/012; F16D 1/116; F16D 2001/103; F16D 2250/0084
USPC ..... 368/324, 322
See application file for complete search history.

(56) References Cited

U.S. PATENT DOCUMENTS

| | | | | |
|---|---|---|---|---|
| 8,944,676 | B2 * | 2/2015 | Conus | G04B 13/022 368/324 |
| 9,457,536 | B2 * | 10/2016 | Conus | G04B 13/022 |
| 9,753,433 | B2 * | 9/2017 | Tanabe | G04B 13/021 |
| 2009/0154303 | A1 | 6/2009 | Vaucher et al. | |
| 2011/0205856 | A1 * | 8/2011 | Zaugg | G04B 13/025 368/185 |

FOREIGN PATENT DOCUMENTS

| | | | |
|---|---|---|---|
| EP | 1 708 045 | A2 | 10/2006 |
| EP | 2 455 821 | A1 | 5/2012 |
| EP | 2 801 868 | A2 | 11/2014 |
| JP | 2009-528524 | A | 8/2009 |
| JP | 2012-167808 | A | 9/2012 |
| JP | 2014-163737 | A | 9/2014 |

OTHER PUBLICATIONS

Extended European Search Report for Application No. EP 18 16 9803 dated Nov. 14, 2018 (7 pages).

* cited by examiner

*Primary Examiner* — Edwin A. Leon
(74) *Attorney, Agent, or Firm* — Harness, Dickey & Pierce, P.L.C.

(57) ABSTRACT

An escape wheel and pinion includes an escape wheel that has an axle, a web arm which holds the axle, and a rim which has a plurality of teeth. The web arm has a spoke which radially extends from the rim, and a comb including a radial spine and cross beams branching from the spoke.

24 Claims, 9 Drawing Sheets

MECHANICAL COMPONENT AND TIMEPIECE

BACKGROUND

1. Technical Field

The present invention relates to a mechanical component and a timepiece.

2. Related Art

A mechanical timepiece is equipped with numerous mechanical components represented by wheels. The mechanical component such as the wheel is fixed (held) by inserting an axle member into a through-hole (web arm) disposed at the center of a rotary member having a plurality of teeth formed on an outer periphery. In the related art, the mechanical component is formed by machining a metal material. However, in recent years, a base material containing silicon has been used as a material of the mechanical component for the timepiece. The mechanical component using silicon as the base material is lighter than that using metal as the base material. Accordingly, an inertia force of the mechanical component can be reduced. Therefore, it is expected to improve energy transmission efficiency. In addition, the silicon allows a shape to be more freely formed using photolithography and etching techniques. Accordingly, there is an advantage that accuracy in processing the mechanical component can be improved by using the silicon as the base material.

JP-T-2009-528524 discloses a mechanical component having a structure in which a shaft is embedded in a central opening of a wheel formed of the silicon. The mechanical component disclosed in JP-T-2009-528524 has a rigid zone and a flexible zone at the central opening of the wheel. The rigid zone has a shape extending along an outer shape of the shaft, and the shaft is placed in the central opening of the wheel. The flexible zone has a tongue-shaped portion which is curved in an arc shape and deformable in a radial direction with respect to the shaft (in an outward direction from the center of the shaft). A distal end portion of the tongue-shaped portion comes into contact with the shaft, thereby preventing the wheel from being rotated with respect to the shaft.

Incidentally, in a case where the wheel formed of the silicon is combined with the shaft formed of a metal material, slippage is more likely to occur between the shaft and the wheel, compared to a combination of metal materials.

In the mechanical component disclosed in JP-T-2009-528524, the tongue-shaped portion disposed in the flexible zone has a function to hold the shaft. More specifically, a configuration is adopted so that the tongue-shaped portion is responsible for fixing the wheel to the shaft and preventing the wheel from being rotated with respect to the shaft. However, the tongue-shaped portion curved in an arc shape within a plane of the wheel (plate) is deformable in the radial direction. Consequently, the wheel is rotated with respect to the shaft, thereby causing a possibility that rotational torques may sustain losses. In addition, the tongue-shaped portion is likely to be deformed in an axial direction (longitudinal direction) of the shaft. Thus, a fixing force is insufficient, and the wheel can be inclined or pulled out from the shaft, thereby causing a possibility that the wheel may be damaged. As a result, there is a possibility of poor quality and poor accuracy of the timepiece.

SUMMARY

An advantage of some aspects of the invention is to solve at least a part of the problems described above, and the invention can be implemented as the following forms or application examples.

Application Example 1

A mechanical component according to this application example includes an axle member, and a rotary member that has a web arm which holds the axle member and a rim which has a plurality of teeth. The web arm has a spoke which extends from the rim, and a comb which is disposed by being branched from the spoke.

According to the configuration of the mechanical component in this application example, the mechanical component has the spoke and the comb as the web arm for fixing the rotary member to the axle member and for preventing rotation of the rotary member. Therefore, the spoke and the comb can share a role of preventing the rotary member from being rotated with respect to the axle member and a role of fixing the rotary member to the axle member by adopting respective suitable configurations. In this manner, the rotary member is prevented from being rotated with respect to the axle member, and the rotary member and the axle member are fixed to each other. Accordingly, it is possible to prevent the rotary member from being inclined or pulled out from the axle member. As a result, it is possible to provide the mechanical component contributing to improved quality and accuracy of the timepiece.

Application Example 2

In the mechanical component according to the application example, it is preferable that the spoke extends in a direction from the rim toward the axle member, and that the comb has a cross beam which extends in a direction intersecting the spoke, and a spine which extends in a direction from the cross beam toward the axle member.

According to the configuration of the mechanical component in this application example, the cross beam extending in the direction intersecting the spoke is bent with respect to the spoke extending in the direction from the rim toward the axle member. In this manner, the spine can be deformed in the direction toward the axle member which is the extending direction of the spine, and in the outward direction from the axle member. Stress generated by this deformation enables the axle member to be placed and held at the center of the rotary member.

Application Example 3

In the mechanical component according to the application example, it is preferable that the comb has a plurality of the cross beams.

According to the configuration of the mechanical component in this application example, a plurality of the cross beams connecting the spoke and the spine to each other are likely to be bent in the direction from the rim toward the axle member within the plane configured to include the spoke and the comb (the cross beam and the spine). Since the mechanical component has a plurality of the cross beams in this way, it is possible to obtain sufficient stress for holding the axle member at the center of the rotary member. On the other hand, a plurality of the cross beams are less likely to be bent in the axial direction (longitudinal direction of the axle member) intersecting the plane configured to include the spoke and the comb (the cross beam and the spine). Therefore, although the spine is likely to be deformed in the direction toward the axle member and in the outward direction from the axle member, the spine is less likely to be deformed in the axial direction. Accordingly, the rotary member and the axle member are fixed to each other. In this manner, it is possible to prevent the rotary member from being inclined or pulled out from the axle member.

Application Example 4

In the mechanical component according to the application example, it is preferable that the spoke, the comb, and the rim are formed of the same material.

According to the configuration of the mechanical component in this application example, the spoke, the comb, and the rim of the rotary member can be formed from the same substrate by using the same etching process. In this manner, it is possible to improve productivity of the rotary member and to reduce the production cost.

Application Example 5

In the mechanical component according to the application example, it is preferable that the axle member has a groove fitted to the spoke.

According to the configuration of the mechanical component in this application example, the spoke is fitted to the groove of the axle member. In this manner, it is possible to reliably prevent the rotary member from being rotated with respect to the axle member.

Application Example 6

In the mechanical component according to the application example, it is preferable that the axle member has a wheel, and that an interval between teeth adjacent to each other in the wheel is equal to a width of the groove.

According to the configuration of the mechanical component in this application example, the interval between the teeth adjacent to each other in the wheel is equal to the width of the groove. Accordingly, when the wheel is formed in a manufacturing step of the axle member, cutting work is carried out in the axial direction of the axle member, thereby enabling the groove to be formed. In this manner, compared to a case where the groove is formed in a step different from a step of forming the wheel, machining can be easily performed, and the productivity can be improved.

Application Example 7

In the mechanical component according to the application example, it is preferable that the axle member has a first tapered portion whose diameter decreases as the first tapered portion is farther away from the web arm, on a side opposite to the wheel with respect to the web arm.

According to the configuration of the mechanical component in this application example, the axle member has the first tapered portion on the side opposite to the wheel with respect to the position held by the web arm of the rotary member. In a step of assembling the mechanical component, in a case where the axle member is inserted from an end portion on the side where the first tapered portion is disposed in the rotary member, the diameter of the axle member increases as the diameter of the axle member in the first tapered portion is closer to the web arm. Therefore, the axle member can be easily inserted into and fixed to the rotary member.

Application Example 8

In the mechanical component according to the application example, it is preferable that the axle member has a protruding portion which protrudes outward with respect to the web arm on the wheel side, and which comes into contact with a surface of the comb on the wheel side, and that the axle member has a second tapered portion formed between the protruding portion and the first tapered portion so that a diameter of the second tapered portion decreases as the second tapered portion is closer to the protruding portion.

According to the configuration of the mechanical component in this application example, the axle member has the second tapered portion formed between the protruding portion and the first tapered portion so that the diameter of the second tapered portion decreases as the second tapered portion is closer to the protruding portion. Here, in a case where the outer shape of the axle member made of metal is formed by machining such as cutting or grinding, a corner portion of an axle portion of the axle member and the protruding portion is not easily formed at a right angle. In some cases, a projecting portion may be formed in which the corner portion projects in an arc shape. In this case, if the axle member is inserted into the rotary member and the protruding portion and the comb are brought into contact with each other, the corner portion of the distal end of the comb interferes with the projecting portion. If the second tapered portion is formed so that the diameter of the second tapered portion decreases as the second tapered portion is closer to the protruding portion, the projecting portion can be placed closer to the center side of the axle member with respect to the corner portion of the distal end of the comb. In this manner, it is possible to mitigate the interference between the corner portion and the projecting portion of the distal end of the comb, and to fix the web arm of the rotary member at a predetermined position of the axle member.

Application Example 9

In the mechanical component according to the application example, it is preferable that the axle member has a recessed portion fitted to the comb, between the protruding portion and the first tapered portion, and that the second tapered portion is disposed in the recessed portion.

According to the configuration of the mechanical component in this application example, the recessed portion is disposed between the protruding portion and the first tapered portion of the axle member, thereby forming a step difference between the first tapered portion and the recessed portion. If the comb is fitted to the recessed portion, one end side of the comb is regulated by the protruding portion, and the other end side of the comb is regulated by the step difference between the first tapered portion and the recessed portion. In this manner, it is possible to more reliably fix the rotary member and the axle member to each other, and to more reliably prevent the axle member from being inclined or pulled out from the rotary member.

Application Example 10

In the mechanical component according to the application example, it is preferable that the rotary member is fixed to the axle member via an adhesive.

According to the configuration of the mechanical component in this application example, the rotary member is fixed to the axle member via the adhesive. Accordingly, it is possible to more reliably prevent the axle member from being inclined or pulled out from the rotary member.

Application Example 11

In the mechanical component according to the application example, it is preferable that an annular fixing member that fixes the rotary member to the axle member is provided.

According to the configuration of the mechanical component in this application example, the rotary member is fixed to the axle member by the annular fixing member. Accordingly, it is possible to more reliably prevent the axle member from being inclined or pulled out from the rotary member.

Application Example 12

A timepiece according to this application example includes the mechanical component described above.

According to the configuration of the timepiece in this application example, the timepiece includes the mechanical component according to any one of the above-described application examples. Accordingly, it is possible to provide a very accurate timepiece having excellent quality.

BRIEF DESCRIPTION OF THE DRAWINGS

Embodiment of the invention will be described with reference to the accompanying drawings, wherein like numbers reference like elements.

DESCRIPTION OF EXEMPLARY EMBODIMENTS

Hereinafter, embodiments according to the invention will be described with reference to the drawings. In these embodiments, a mechanical timepiece will be described as an example of a timepiece according to the invention. Then, as an example of a mechanical component according to the invention, an escape wheel & pinion will be described which is one of the wheels configuring a timepiece component in a movement of the mechanical timepiece. In the following respective drawings, in order to allow each layer and each member to have a recognizable size, each layer or each member is illustrated by dimensions different from actual dimensions, in some cases.

Embodiment 1

Mechanical Timepiece

Figure 1:
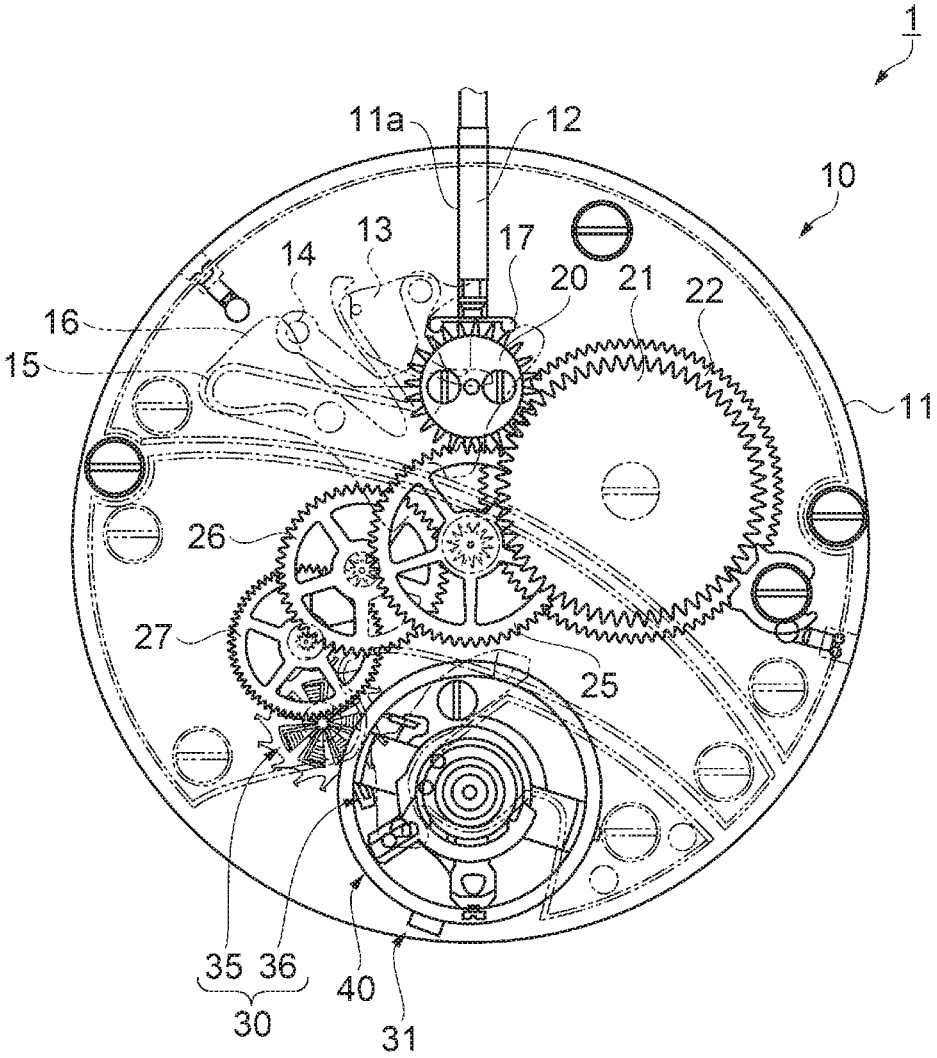
FIG. 1 is a plan view on a front side of a movement of a mechanical timepiece according to the present embodiment.

First, a mechanical timepiece 1 serving as a timepiece according to this embodiment will be described. FIG. 1 is a plan view on a front side of a movement of the mechanical timepiece according to this embodiment. As illustrated in FIG. 1, the mechanical timepiece 1 according to this embodiment is configured to include a movement 10 and a casing (not illustrated) which accommodates the movement 10.

A forward side of the page in FIG. 1 is referred to as a front side, and a rearward side is referred to as a rear side. The movement 10 has a main plate 11 configuring a substrate. A dial (not illustrated) is located on the rear side of the main plate 11. A train wheel incorporated on the front side of the movement 10 is referred to as a front train wheel, and a train wheel incorporated on the rear side of the movement 10 is referred to as a rear train wheel.

A winding stem guide hole 11*a* is formed in the main plate 11, and a winding stem 12 is rotatably incorporated in the winding stem guide hole 11*a*. A position in an axial direction of the winding stem 12 is determined by a switching device having a setting lever 13, a yoke 14, a yoke spring 15, and a setting lever jumper 16. In addition, a winding pinion 17 is rotatably disposed in a guide axle portion of the winding stem 12.

Based on this configuration, if the winding stem 12 rotates in a state where the winding stem 12 is located at a first winding stem position (0-$^{th}$ stage) nearest to the inside of the movement 10 along a rotation axis direction, the winding pinion 17 is rotated via rotation of a clutch wheel (not illustrated). Then, as the winding pinion 17 is rotated, a crown wheel 20 meshing with the winding pinion 17 is rotated. Then, as the crown wheel 20 is rotated, a ratchet wheel 21 meshing with the crown wheel 20 is rotated. Furthermore, as the ratchet wheel 21 is rotated, a mainspring (power source) (not illustrated) accommodated in a movement barrel 22 is wound up.

In addition to the movement barrel (mechanical component) 22 described above, the front train wheel of the movement 10 is configured to include a center wheel & pinion (mechanical component) 25, a third wheel & pinion (mechanical component) 26, and a second wheel & pinion (mechanical component) 27. The front train wheel functions to transmit a rotational force of the movement barrel 22. In addition, an escapement mechanism 30 and a speed control mechanism 31 for controlling the rotation of the front train wheel are arranged on the front side of the movement 10.

The center wheel & pinion 25 meshes with the movement barrel 22. The third wheel & pinion 26 meshes with the center wheel & pinion 25. The second wheel & pinion 27 meshes with the third wheel & pinion 26. The escapement mechanism 30 controls the rotation of the above-described front train wheel, and includes an escape wheel & pinion (mechanical component) 35 meshing with the second wheel & pinion 27 and a pallet fork (mechanical component) which causes the escape wheel & pinion 35 to escape so as to be regularly rotated. The speed control mechanism 31 controls the speed of the above-described escapement mechanism 30, and includes a balance with hairspring (mechanical component) 40.

Escape Wheel & Pinion

Figure 2:
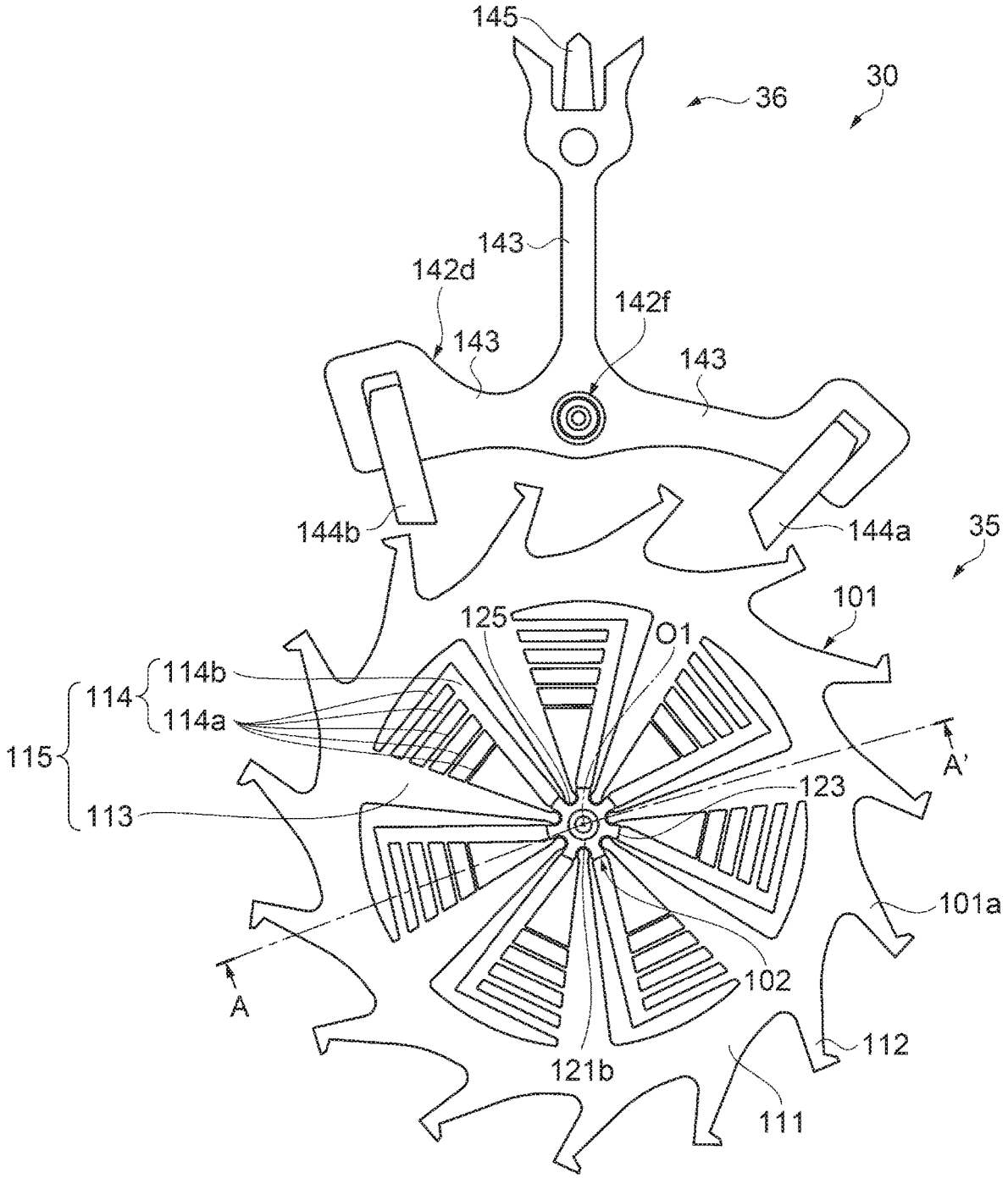
FIG. 2 is a plan view of an escapement mechanism according to Embodiment 1.
Figure 3:
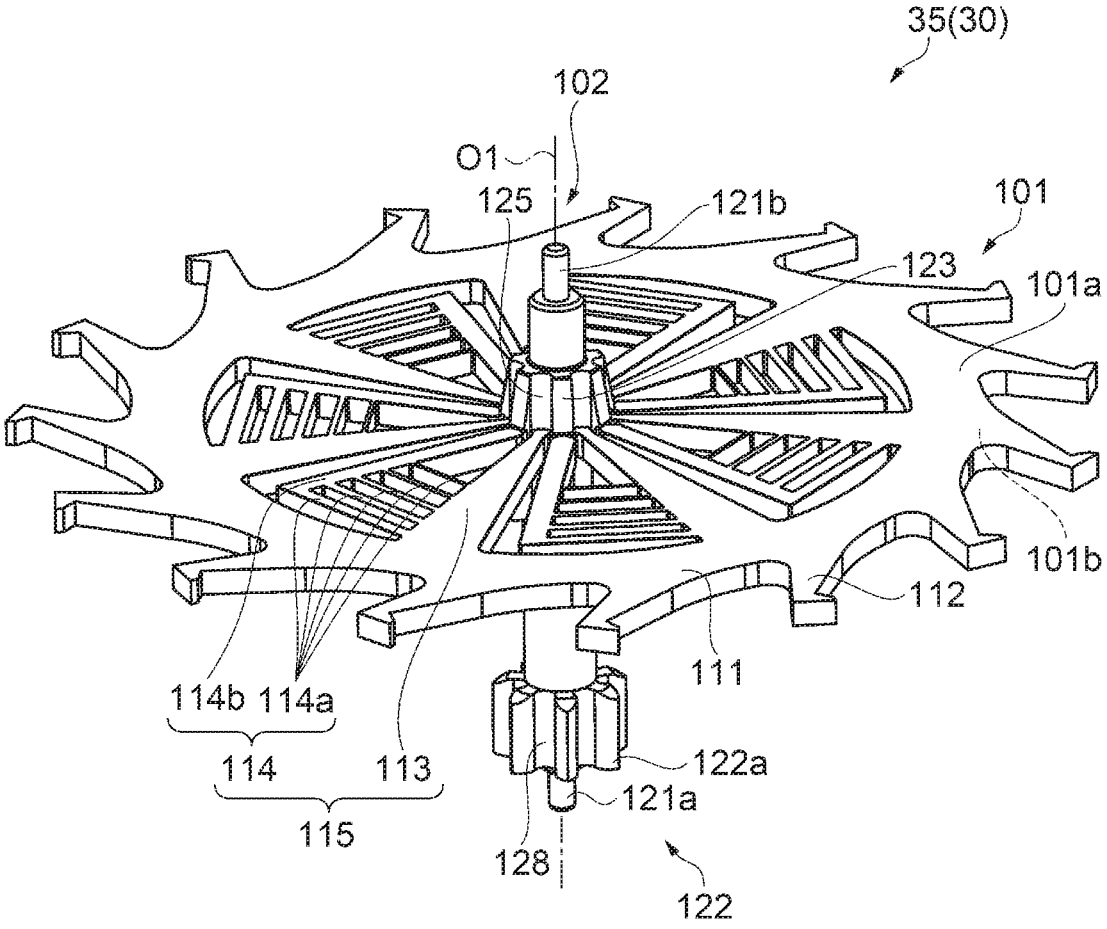
FIG. 3 is a perspective view when an escape wheel & pinion serving as a mechanical component according to Embodiment 1 is viewed from a front surface side.
Figure 4:
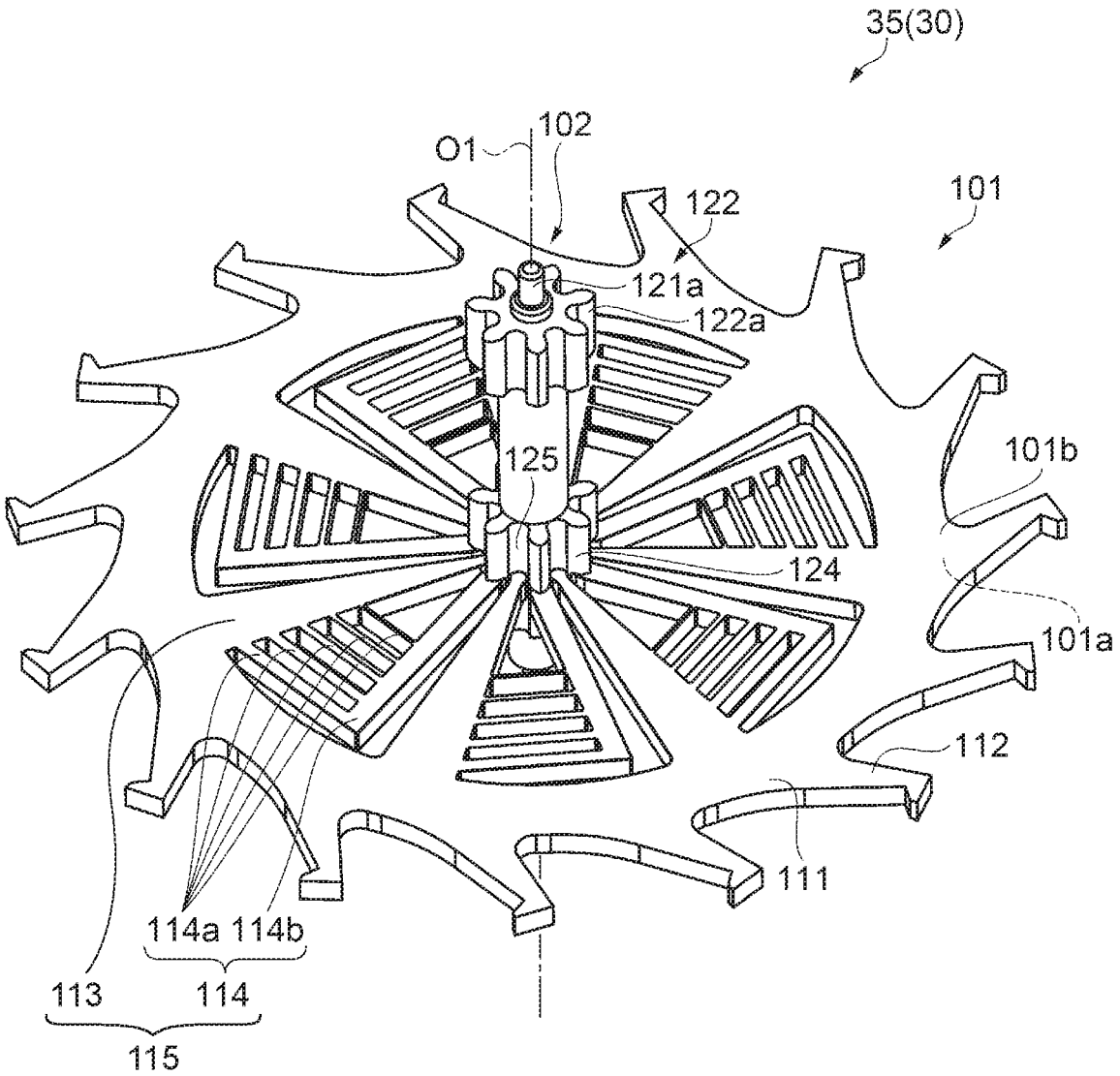
FIG. 4 is a perspective view when the escape wheel & pinion serving as the mechanical component according to Embodiment 1 is viewed from a rear surface side.
Figure 5:
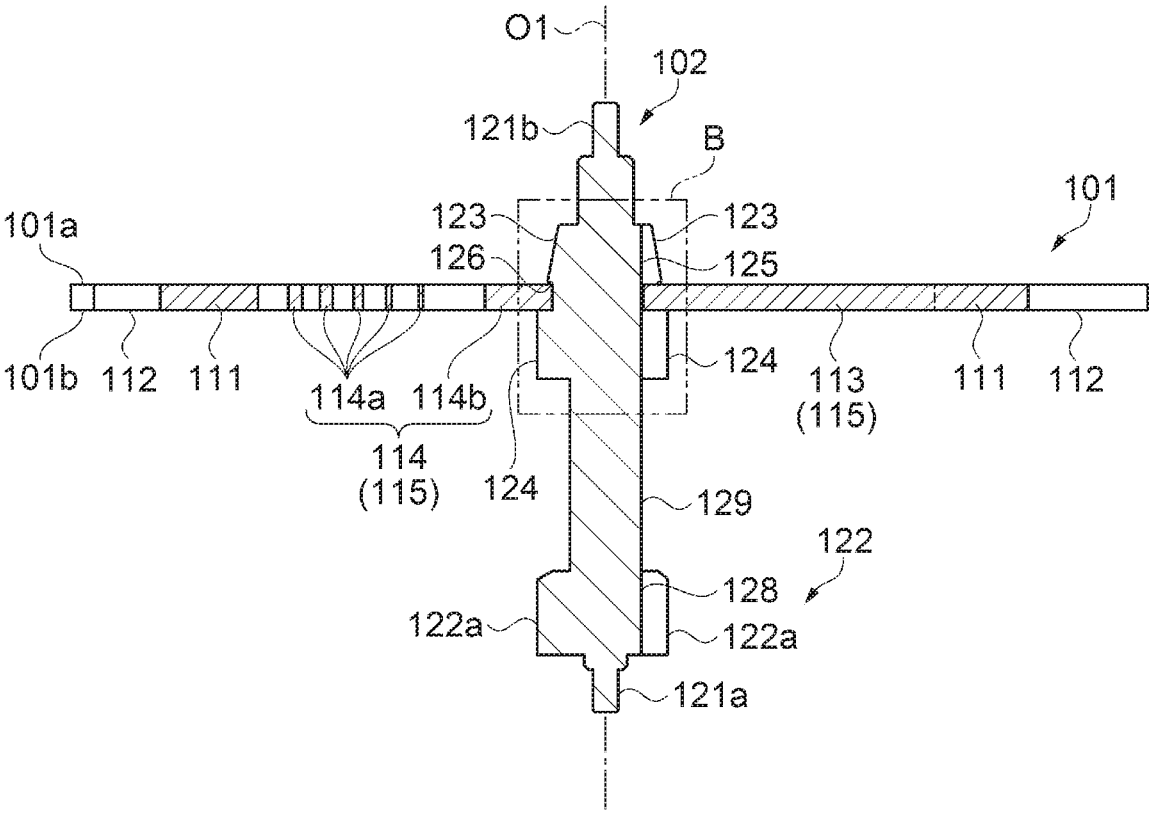
FIG. 5 is a sectional view taken along line A-A' in FIG. 2.
Figure 6:
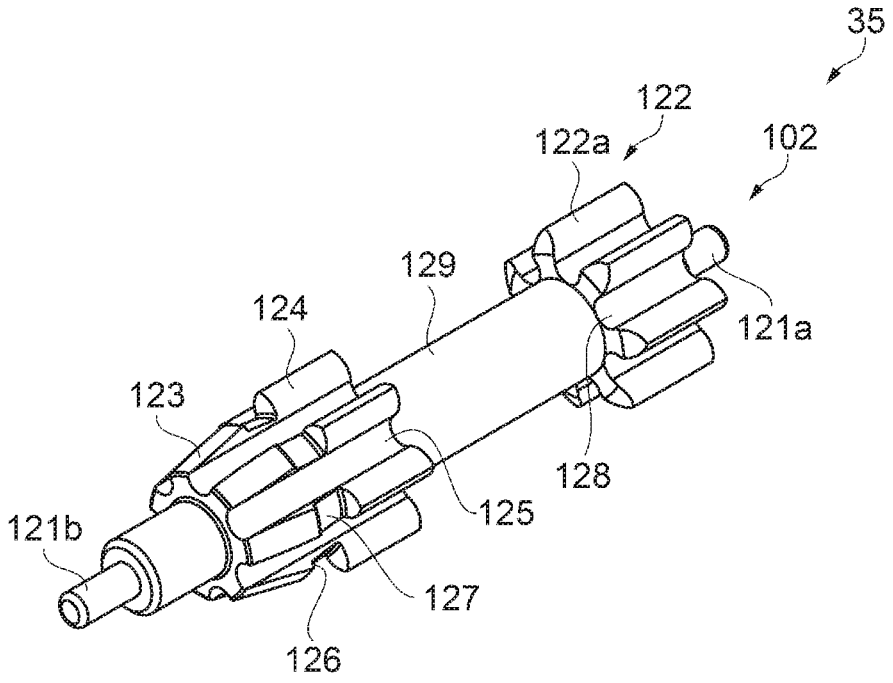
FIG. 6 is a perspective view of an axle member of the escape wheel & pinion according to Embodiment 1.
Figure 7:
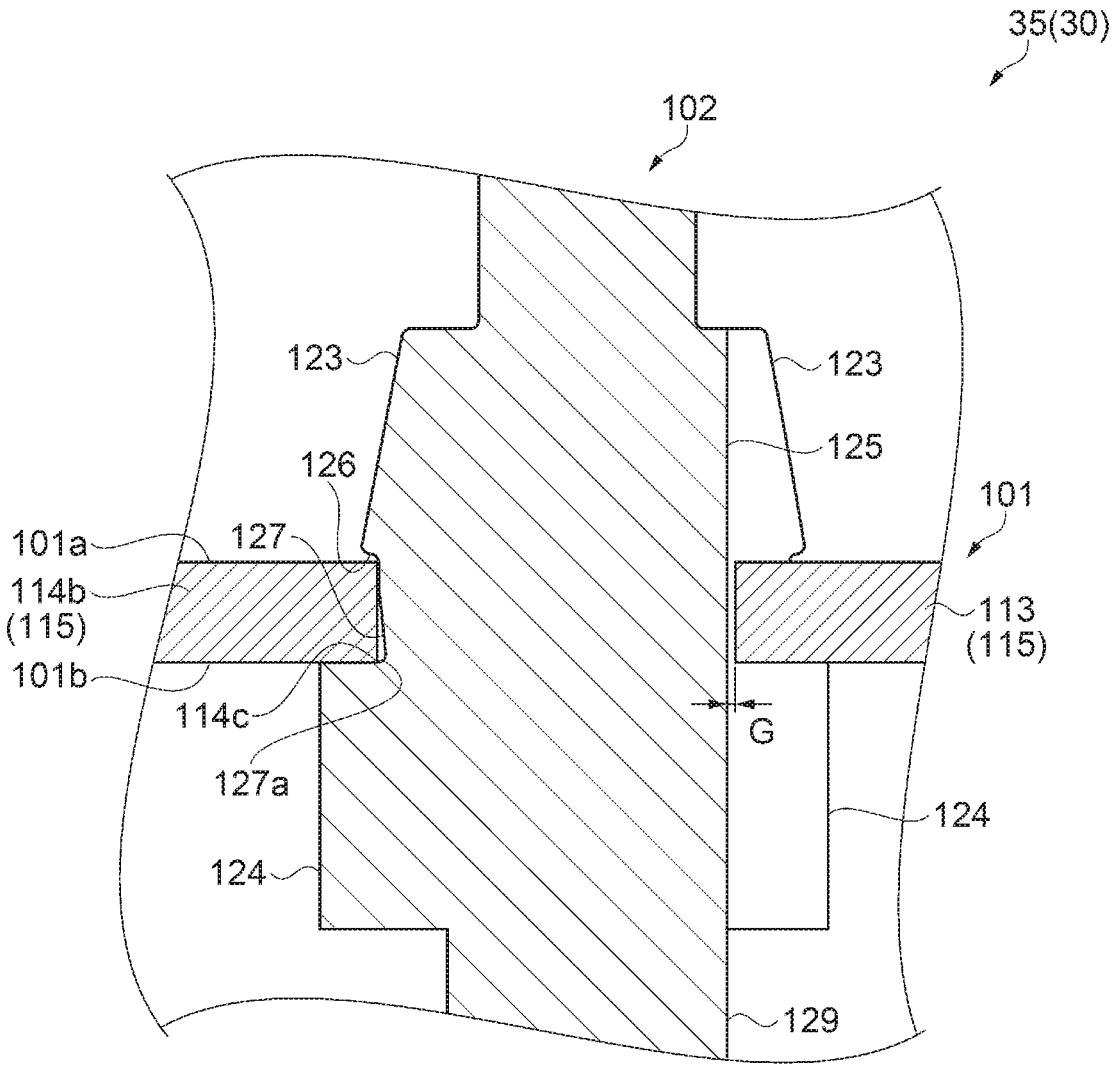
FIG. 7 is a partially enlarged sectional view of a B-portion in FIG. 5.

Next, the escape wheel & pinion 35 included in the escapement mechanism 30 according to the Embodiment 1 will be described in more detail. FIG. 2 is a plan view of the escapement mechanism according to Embodiment 1. FIG. 3 is a perspective view when the escape wheel & pinion serving as the mechanical component according to Embodiment 1 is viewed from the front surface side. FIG. 4 is a perspective view when the escape wheel & pinion serving as the mechanical component according to Embodiment 1 is viewed from the rear surface side. FIG. 5 is a sectional view taken along line A-A' in FIG. 2. FIG. 6 is a perspective view of an axle member of the escape wheel & pinion according to Embodiment 1. FIG. 7 is a partially enlarged sectional view of a B-portion in FIG. 5.

As illustrated in FIGS. 2 to 5, the escape wheel & pinion 35 included in the escapement mechanism 30 includes an escape wheel 101 serving as a rotary member, and an axle member (rotary axle) 102 which is fixed to the escape wheel 101 on the same axis (axis O1).

In the following description, a longitudinal direction along the axis O1 of the escape wheel 101 and the axle member 102 is simply referred to as an axial direction. A front surface 101*a* and a rear surface 101*b* of the escape wheel 101 are orthogonal to the axis O1 (line passing through the center of the axle member 102 along the axial direction). A direction passing through the axis O1 within a plane parallel to the front surface 101*a* and the rear surface 101*b* of the escape wheel 101 is referred to as a radial direction. A direction in which the escape wheel 101 and the axle member 102 turnaround the axis O1 is referred to as a circumferential direction.

In the escape wheel 101, the front surface 101*a* serving as one surface and the rear surface 101*b* serving as the other surface on a side opposite to the one surface are flat (planar) surfaces, and have a plate-shape having a uniform thickness over the entire surface. The escape wheel 101 is made of a material having a crystal orientation such as single crystal silicon, or a material such as metal.

The escape wheel 101 has a rim 111 having a plurality of teeth 112, and a web arm 115 (web arm) which holds (engages) the axle member 102. The rim 111 is the annular hoop at an outer circumferential edge of the escape wheel 101. The teeth 112 protrude outward from an outer periphery of the rim 111, and are formed in a special hook shape. Pallet stones 144*a* and 144*b* of the pallet fork 36 (to be described later) come into contact with each distal end of a plurality of the teeth 112.

The web arm 115 (holding portion) is placed on the axle member 102 side (radially inward) with respect to the rim 111. In this embodiment, the escape wheel 101 has seven web arms 115 (holding portions). The web arms 115 are placed at seven locations in the circumferential direction of the annular rim 111 at an equal pitch of 360/7°. The number of the web arms 115 may be in a range of three to seven, or may be seven or more, and is not particularly limited. Each web arm 115 has a spoke 113 (first holding portion) which radially extends from the rim 111, and a comb 114 (second holding portion) which is disposed by being branched from the spoke 113. The spoke 113, the comb 114 (the cross beam 114*a* and the spine 114*b*), and the rim 111 are integrally formed of the same material (monolithic).

The axle member 102 is inserted into a region surrounded by the web arm 115 (the spoke 113 and the comb 114) in the center portion of the escape wheel 101. In other words, the web arm 115 configures a through hole for inserting the axle member 102 into the center portion of the escape wheel 101.

The spoke 113 extends in a radial direction from the rim 111 toward the axle member 102. The spoke 113 has a function to prevent the escape wheel 101 from being rotated with respect to the axle member 102, by being fitted to the groove 125. The distal end of the spoke 113 is located on the center side of the axle member 102 (radially inwardly relative to) from the distal end of the spine 114*b* of the comb 114.

The comb 114 has at least one cross beam 114*a* (first holding portion) and the spine 114*b* (second holding portion). The comb 114 has a function to fix the axle member 102 to the center of the escape wheel 101, and a function to prevent the escape wheel 101 from being inclined or pulled out from the axle member 102.

The cross beam 114*a* is connected to the spoke 113, and extends in a direction intersecting the longitudinal extending direction of the spoke 113. The comb 114 has a plurality of the cross beams 114*a* (fingers). The cross beams 114*a* are arranged substantially parallel to each other. The cross beams 114*a* have a function to relieve stress applied to the spine 114*b* in the longitudinal extending direction of the spine 114*b*. The spine 114*b* is connected to a plurality of the cross beams 114*a*, and extends in a radial direction toward the axle member 102. The spine 114*b* is fitted to a recessed portion 126 (notch).

As illustrated in FIG. 2, if the escape wheel 101 is viewed from the axle member 102, the spoke 113 and the spine 114*b* extend radially outward in the radial direction. Within a plane parallel to the front surface 101*a* of the escape wheel 101, the longitudinally extending direction of the spoke 113 and the longitudinally extending direction of the spine 114*b* are directions extending along the radial direction, but are not parallel to each other (they are divergent). The longitudinally extending direction of the cross beam 114*a* is a direction intersecting the extending direction of the spoke 113 and the extending direction of the spine 114*b* within the plane parallel to the front surface 101*a* of the escape wheel 101 (roughly parallel to a tangent of the rim 111).

A plurality of the cross beams 114*a* each formed in a beam shape between the spoke 113 and the spine 114*b* are less likely to be bent in the extending direction within a plane including a plurality of the crossbeams 114*a* (the front surface 101*a* and the rear surface 101*b* of the escape wheel 101). However, the cross beams 114*a* are more likely to be bent in a direction intersecting the extending direction. In addition, the cross beams 114*a* are less likely to be bent in the axial direction intersecting with the plane including the plurality of the cross beams 114*a*.

Therefore, when the axle member 102 is inserted into the escape wheel 101, a plurality of the cross beams 114*a* are bent, and are deformed in the longitudinal extending direction of the spine 114*b* with respect to the axle member 102. In this manner, the spine 114*b* can be easily fitted to the recessed portion 126. In addition, when an external force is applied to the escape wheel & pinion 35, a plurality of the crossbeams 114*a* are likely to be deformed in the longitudinal extending direction of the spine 114*b*. Accordingly, the axle member 102 can be held at the center of the escape wheel 101. On the other hand, a plurality of the cross beams 114*a* are less likely to be deformed in the axial direction, that is, in the direction in which the axle member 102 is pulled out from the escape wheel 101. Therefore, it is possible to prevent the escape wheel 101 from being inclined or pulled out from the axle member 102.

For example, the escape wheel 101 is formed by performing anisotropic etching so as to deeply dig a wafer-like substrate in the thickness direction of the substrate via a photoresist pattern formed on the front surface of the substrate containing silicon. The spoke 113, the comb 114, the rim 111 of the escape wheel 101, and the like can be formed from the same substrate by using the same etching step, and a plurality of escape wheels 101 can be taken from one substrate. Accordingly, the productivity of the escape wheel 101 can be improved, and the production cost of the escape wheel 101 can be reduced. In addition, the escape wheel 101 is formed by using photolithography and etching techniques. Therefore, there is an advantage in that a shape of the escape wheel 101 can be more freely designed and the processing accuracy can be improved.

A plurality of the teeth 112 of the escape wheel & pinion 35 (escape wheel 101) meshes with the pallet fork 36. The pallet fork 36 includes a pallet fork body 142*d* formed in a T-shape to have three pallet beams 143, and a pallet staff 142*f* as an axle. The pallet fork body 142*d* is configured to be pivotable by the pallet staff 142*f*. Both ends of the pallet staff 142*f* are respectively and pivotally supported with respect to the main plate 11 (refer to FIG. 1) and a pallet bridge (not illustrated).

In the three pallet beams 143, the pallet stones 144*a* and 144*b* are disposed in the distal end of the two pallet beams 143, and a pallet fork receptacle 145 is attached to the distal end of the remaining one pallet beam 143. The pallet stones 144*a* and 144*b* are ruby formed in a quadrangular prism shape, and are adhered and fixed to the pallet beam 143 by using an adhesive.

When the pallet fork 36 configured in this way pivots around the pallet staff 142*f*, the pallet stone 144*a* or the pallet stone 144*b* comes into contact with the distal end of the teeth 112 of the escape wheel & pinion 35. In addition, in this case, the pallet beam 143 having the pallet fork receptacle 145 attached thereto comes into contact with a banking pin (not illustrated). In this manner, the pallet fork 36 does not pivot any further in the same direction. As a result, the rotation of the escape wheel & pinion 35 is temporarily stopped.

In a plan view illustrated in FIG. 2, the axle member 102 is placed in the center portion of the escape wheel 101. As illustrated in FIGS. 3 to 6, the axle member 102 has tenon portions 121*a* and 121*b*, an escape pinion portion 122 serving as a wheel, a first tapered portion 123 (tapered ribs), and a protruding portion 124 (stops) (refer to FIGS. 4 to 6). The axle member 102 is inserted from the rear surface 101*b* side into the through hole surrounded by the web arm 115 of the escape wheel 101. The axle member 102 is fixed to the escape wheel 101 in a state where the first tapered portion 123 protrudes from the front surface 101*a* of the escape wheel 101 toward the other end side in the axial direction.

The tenon portions 121*a* and 121*b* are located at both end portions in the axial direction of the axle member 102. The tenon portion 121*a* located on one end side in the axial direction of the tenon portions 121*a* and 121*b* is rotatably supported by a train wheel bridge (not illustrated), and the tenon portion 121*b* located on the other end side in the axial direction is rotatably supported by the main plate 11. A portion between the escape pinion portion 122 and the protruding portion 124 in the axle member 102 is referred to as an axle portion 129 (refer to FIGS. 5 and 6).

The escape pinion portion 122 serving as the wheel is formed close to the tenon portion 121*a* in the axial direction of the axle member 102. The escape pinion portion 122 has a plurality of teeth 122*a*. A plurality of the teeth 122*a* is formed so as to protrude outward in the radial direction from the axle portion 129. The escape pinion portion 122 meshes with the wheel of the second wheel & pinion 27 (refer to FIG. 1). In this manner, the rotational force of the second wheel & pinion 27 is transmitted to the axle member 102, thereby rotating the escape wheel & pinion 35.

In this embodiment, the escape pinion portion 122 has seven teeth 122*a*. The teeth 122*a* are arranged at seven locations in the circumferential direction of the escape pinion portion 122 at an equal pitch of 360/7°. Therefore, grooves 128 are also arranged at seven locations in the circumferential direction of the escape pinion portion 122 at an equal pitch of 360/7°. Each groove 128 is disposed between adjacent teeth 122*a* in the escape pinion portion 122. Therefore, the number of the grooves 128 is the same as the number of the teeth 122*a*. An interval between the adjacent teeth 122*a* is equal to a width of the groove 128. Although the number of the teeth 122*a* is seven in this embodiment, the number may be in a range of three to seven, or may be seven or more, and is not particularly limited.

As illustrated in FIGS. 3, 5, and 6, the first tapered portion 123 is formed close to the tenon portion 121*b* in the axial direction of the axle member 102, that is, on a side opposite to the escape pinion portion 122 with respect to the web arm 115 of the escape wheel 101 (refer to FIG. 5). The first tapered portion 123 has a diameter larger than that of the tenon portions 121*a* and 121*b*. The first tapered portion 123 is formed so that the diameter decreases as the first tapered portion 123 is farther away from the web arm 115 toward the tenon portion 121*b* side. In other words, the first tapered portion 123 is formed so that the diameter increases as the first tapered portion 123 is closer to the protruding portion 124 from the tenon portion 121*b* side. The first tapered portion 123 tapers towards the tenon portion 121*b* and away from the protruding portion 124.

The protruding portion 124 is on the escape pinion portion 122 side with respect to the web arm 115. A plurality of the protruding portions 124 are formed so as to protrude outward in the radial direction from the axle portion 129. The protruding portion 124 is in contact with a surface (rear surface 101*b*) on the escape pinion portion 122 side of the spine 114*b* (comb 114) (refer to FIG. 5). In this embodiment, the number of the protruding portions 124 is the same as the number of the teeth 122*a* of the escape pinion portion 122.

The groove 125 fitted to the spoke 113 is disposed between the protruding portions 124 that are adjacent to each other. The interval between the adjacent protruding portions 124 is equal to the width of the groove 125. The width of the groove 125 is equal to the width of the groove 128. Therefore, the width of the groove 125 is equal to the interval between the adjacent teeth 122*a* of the escape pinion portion 122.

The groove 125 and the groove 128 are arranged at the same position in the circumferential direction of the axle member 102. In other words, if the axle member 102 is planarly viewed from the tenon portion 121*b* side in the axial direction in FIG. 6, the groove 125 and the groove 128 are arranged so as to overlap each other (align with each other). The groove 125 extends along the axial direction in the axle member 102 from a position where the protruding portion 124 is formed to a position where the first tapered portion 123 is formed.

As illustrated in FIGS. 5 to 7, the recessed portion 126 fitted to the spine 114*b* of the comb 114 is placed between the protruding portion 124 and the first tapered portion 123 in the axial direction of the axle member 102. The recessed portion 126 is recessed inward (toward the center of the axle member 102) from the protruding portion 124 and the first tapered portion 123 in the radial direction. The recessed portion 126 is provided with a second tapered portion 127 formed so that the diameter decreases as the second tapered portion 127 is closer to the protruding portion 124 (refer to FIG. 7).

The axle member 102 is formed by performing machining such as cutting and grinding on a member serving as the axle member 102. As a material of the axle member 102, it is preferable to use carbon steel which is a material having sufficient heat resistance against the temperature of oxidation treatment such as thermal oxidation treatment performed at high temperature. In addition to the material excellent in rigidity and heat resistance as described above, the carbon steel is particularly suitable as the material of the axle member 102 since the carbon steel is a highly processing-available material in cutting and grinding. Tantalum (Ta) or tungsten (W) may be used as the material of the axle member 102.

As illustrated in FIG. 6, the groove 125 is formed so as to be recessed from the first tapered portion 123. The groove 125 has a function to prevent the escape wheel 101 from being rotated with respect to the axle member 102, by being fitted to the spoke 113. The groove 125 is linearly formed along the axial direction of the axle member 102 from the position where the first tapered portion 123 is formed to the position where the protruding portion 124 is formed. The groove 128 is located on an extension line of the groove 125 along the axial direction of the axle member 102.

In this embodiment, the groove 125 is formed as follows. In a step of forming the escape pinion portion 122, cutting is performed inward (toward the center of the axle member 102) in the radial direction from the front surface of the axle member 102, in a straight line shape along the axial direction from the tenon portion 121*a* side to the tenon portion 121*b* side. That is, the groove 125 and the groove 128 which overlap each other in a plan view (axially align or collinearly extend) in the axial direction are formed to serve as one groove in the same step. In this manner, compared to a case where the groove 125 is formed during a step different from the step of forming the escape pinion portion 122, machining can be easily performed, and the productivity can be improved.

As a result, the groove 125 and the groove 128 are formed at the same position in the circumferential direction of the axle member 102. The width of the groove 125 is formed to be equal to the width of the groove 128, that is, the interval between the adjacent teeth 122*a* of the escape pinion portion 122. In addition, similarly to the grooves 128, the grooves 125 are also formed at seven locations in the circumferential direction of the axle member 102 at an equal pitch of 360/7°.

In this embodiment, a bottom portion of the groove 125 and an outer peripheral surface of the axle portion 129 are located at the same distance in the radial direction from the center of the axle member 102. Accordingly, the groove is not formed in the axle portion 129. However, for example, in a case where the diameter of the axle portion 129 is larger (thicker) than the diameter according to this embodiment, a configuration may be adopted in which the groove is formed in the axle portion 129.

As described above, the spoke 113 is fitted to the groove 125. When the axle member 102 is inserted into the escape wheel 101 from the tenon portion 121*b* side, if the first tapered portion 123 reaches the position of the web arm 115, the spoke 113 is fitted to the groove 125. Then, in a state where the spoke 113 is fitted to the groove 125, the axle member 102 is inserted until the protruding portion 124 comes into contact with the rear surface 101*b* of the spine 114*b*.

As illustrated in FIG. 7, in the state where the spoke 113 is fitted to the groove 125, a gap G is designed to exist between the spoke 113 and the groove 125. In this state, no stress is generated between the axle member 102 and the spoke 113. However, when an external force is applied to the escape wheel & pinion 35 in a state where the mechanical timepiece 1 (movement 10) having the escape wheel & pinion 35 incorporated therein is operated, the spoke 113 may come into contact with the axle member 102.

As illustrated in FIG. 6, the groove 125 is formed to be recessed from the bottom portion (second tapered portion 127) of the recessed portion 126 (to be described later). Therefore, a step difference is formed between the groove 125 and the recessed portion 126 in the circumferential direction. The distal end of the spoke 113 is located on the center side of the axle member 102 from the bottom portion of the recessed portion 126. Therefore, even if the external force is applied in the circumferential direction which is the rotation direction of the escape wheel & pinion 35, a state where the spoke 113 is fitted to the groove 125 is maintained.

In this manner, it is possible to prevent the escape wheel 101 from being rotated with respect to the axle member 102.

The recessed portion 126 (lip) is formed between the first tapered portion 123 and the protruding portion 124 in the axial direction so as to be recessed inward (toward the center side of the axle member 102) from the first tapered portion 123. Therefore, a step difference is formed between the first tapered portion 123 and the recessed portion 126 in the axial direction. The recessed portion 126 has a function to prevent the escape wheel 101 from being pulled out from the axle member 102, by being fitted to (engaging) the spine 114*b* of the comb 114.

The recessed portion 126 is formed by performing cutting one perimeter in the circumferential direction between the first tapered portion 123 and the protruding portion 124 in the axial direction, and the inside (center side of the axle member 102) from the front surface of the axle member 102. The recessed portion 126 is divided into seven locations in the circumferential direction by the grooves 125 formed from the first tapered portion 123 to the protruding portion 124 along the axial direction intersecting the circumferential direction.

When the axle member 102 is inserted into the escape wheel 101 from the tenon portion 121*b* side, if the first tapered portion 123 reaches the position of the web arm 115 and the spoke 113 is fitted to the groove 125, the distal end of the spine 114*b* comes into contact with the first tapered portion 123. The diameter of the first tapered portion 123 on the tenon portion 121*b* side is smaller than the diameter of the protruding portion 124 side. Accordingly, the axle member 102 can be easily inserted into the through-hole surrounded by the web arm 115 of the escape wheel 101.

The diameter of the first tapered portion 123 increases as the first tapered portion 123 is closer to the protruding portion 124. Accordingly, if the axle member 102 is further inserted in a state where the distal end of the spine 114*b* is in contact with the first tapered portion 123, as the recessed portion 126 and the spine 114*b* are closer to each other, a plurality of the cross beams 114*a* are bent, and the spine 114*b* is deformed outward with respect to the axle member 102. Then, the spine 114*b* gets over a step difference between the first tapered portion 123 and the recessed portion 126, and is easily fitted to the recessed portion 126.

In addition, since the spine 114*b* is deformed outward with respect to the axle member 102, stress is applied to the combs 114 placed at a plurality of locations (seven locations in this embodiment) in the circumferential direction of the axle member 102. Mutual action to balance the stress starts, thereby adjusting mutual positional relationships therebetween. In this manner, the combs 114 arranged at a plurality of the locations are arranged so that the center of the axle member 102 overlaps the center of the escape wheel 101 (coaxial arrangement).

The spine 114*b* is interposed between the first tapered portion 123 and the protruding portion 124 in a state where the spine 114*b* is fitted to the recessed portion 126. In the spine 114*b*, the rear surface 101*b* side is in contact with the protruding portion 124. Accordingly, the protruding portion 124 regulates the movement of the spine 114*b* toward the tenon portion 121*a* side in the axial direction. In the spine 114*b*, there is a step difference between the first tapered portion 123 and the recessed portion 126 on the front surface 101*a* side. Accordingly, this step difference regulates the movement of the spine 114*b* toward the tenon portion 121*b* side. In this manner, the spine 114*b* is prevented from being displaced in the axial direction from the recessed portion 126.

As described above, the spine 114*b* is likely to be deformed outward with respect to the axle member 102. Accordingly, the axle member 102 can be easily inserted into the escape wheel 101. On the other hand, the spine 114*b* is less likely to be deformed in the axial direction, that is, in a direction in which the axle member 102 is pulled out from the escape wheel 101. Accordingly, it is possible to prevent the escape wheel 101 from being inclined or pulled out from the axle member 102.

In addition, as illustrated in FIG. 7, the recessed portion 126 is formed so that the depth of the bottom portion of the recessed portion 126 increases (become deeper) as the recessed portion 126 is closer to the protruding portion 124 from the first tapered portion 123 side. That is, the bottom portion of the recessed portion 126 has the second tapered portion 127 (referred to also as a tapered bottom/back wall or a tapered base) whose diameter decreases as the second tapered portion 127 is closer to the protruding portion 124 from the first tapered portion 123 side. The second tapered portion 127 tapers toward the protruding portion 124.

The surface (rear surface 101*b*) of the spine 114*b* on the escape pinion portion 122 side is in contact with the protruding portion 124. The corner portion in the distal end (inner peripheral side end portion) of the spine 114*b* on the side opposite to the protruding portion 124 (first tapered portion 123 side) is in contact with the bottom portion (second tapered portion 127) of the recessed portion 126. A portion including the corner portion 114*c* on the protruding portion 124 side in the distal end of the spine 114*b* is apart from the bottom portion (second tapered portion 127) of the recessed portion 126.

Here, in a case where the recessed portion 126 is formed by machining such as cutting, the corner portion of the bottom portion and the side end surface of the recessed portion 126 is less likely to be formed to have a right angle. In some cases, a projecting portion 127*a* whose cross section projects in an arc shape is formed in the corner portion with the side end surface on the recessed portion 126 side of the protruding portion 124. On the other hand, the corner portion 114*c* of the distal end of the spine 114*b* is formed to have a substantially right angle, because the corner portion 114*c* is formed by means of anisotropic etching. Therefore, in a case where the second tapered portion 127 is not formed in the bottom portion of the recessed portion 126, if the axle member 102 is inserted into the escape wheel 101 and the side end surface on the recessed portion 126 side of the protruding portion 124 is brought into contact with the rear surface 101*b* of the spine 114*b*, the corner portion 114*c* of the distal end of the spine 114*b* interferes with the projecting portion 127*a*.

If the corner portion 114*c* of the distal end of the spine 114*b* interferes with the projecting portion 127*a*, it is difficult to reliably insert the axle member 102 until the protruding portion 124 comes into contact with the rear surface 101*b* of the spine 114*b*. If the axle member 102 cannot be inserted until the protruding portion 124 comes into contact with the rear surface 101*b* of the spine 114*b*, the spine 114*b* is not sufficiently fitted to the recessed portion 126, thereby causing the escape wheel 101 to be inclined from the axle member 102.

In this embodiment, the second tapered portion 127 is formed in the bottom portion of the recessed portion 126 so that the diameter decreases as the second tapered portion 127 is closer to the protruding portion 124. Accordingly, the projecting portion 127*a* can be placed close to the center side of the axle member 102 with respect to the corner portion 114*c* of the spine 114*b* (apart from the corner portion 114*c*). In this manner, the interference is mitigated between the corner portion 114*c* of the distal end of the spine 114*b* and the projecting portion 127*a*. Therefore, in a state where the spine 114*b* is in contact with the protruding portion 124, the spine 114*b* can be reliably fitted to the recessed portion 126.

In order to avoid the interference between the corner portion 114*c* of the distal end of the spine 114*b* and the projecting portion 127*a*, a method is conceivable in which the corner portion 114*c* of the distal end of the spine 114*b* is formed in an arc shape. In order to form the corner portion 114*c* in the arc shape, it is necessary to perform a step of repeating thermal oxidation and etching on the escape wheel 101 or a step of performing isotropic etching on the escape wheel 101. However, even if thermal oxidation and etching are repeated, it is difficult to form the corner portion 114*c* in the arc shape to an extent that can correspond to the projecting portion 127*a*. In a case of adding a step of performing the isotropic etching, the number of man-hours is increased.

In this embodiment, when the recessed portion 126 is formed in the axle member 102, the second tapered portion 127 can be formed in the bottom portion of the axle member 102. Accordingly, without increasing the number of man-hours, it is possible to more easily and reliably mitigate the interference between the corner portion 114*c* of the distal end of the spine 114*b* and the projecting portion 127*a*.

As described above, according to the configuration of the escape wheel & pinion 35 serving as the mechanical component in Embodiment 1, the escape wheel 101 can be prevented from being rotated with respect to the axle member 102. Accordingly, it is possible to provide the escape wheel & pinion 35 in which rotational torques sustain little loss. Further, it is possible to prevent the escape wheel 101 from being inclined or pulled out from the axle member 102. Therefore, it is possible to provide the escape wheel & pinion 35 which is highly resistant against deformation caused by external stress. In addition, the axle member 102 is inserted and fitted into the web arm 115 of the escape wheel 101. In this manner, it is possible to easily and reliably fix the axle member 102 to the web arm 115 without using members other than the axle member 102 and the escape wheel 101. Therefore, the escape wheel & pinion 35 can be efficiently manufactured through a simple step.

Embodiment 2

In Embodiment 2, the configuration of the timepiece is the same as that of Embodiment 1. However, a configuration of the escape wheel & pinion serving as the mechanical component is partially different. Here, with regard to the configuration of the escape wheel & pinion serving as the mechanical component according to Embodiment 2, points different from those according to Embodiment 1 will be described.

Escape Wheel & Pinion

Figure 8:
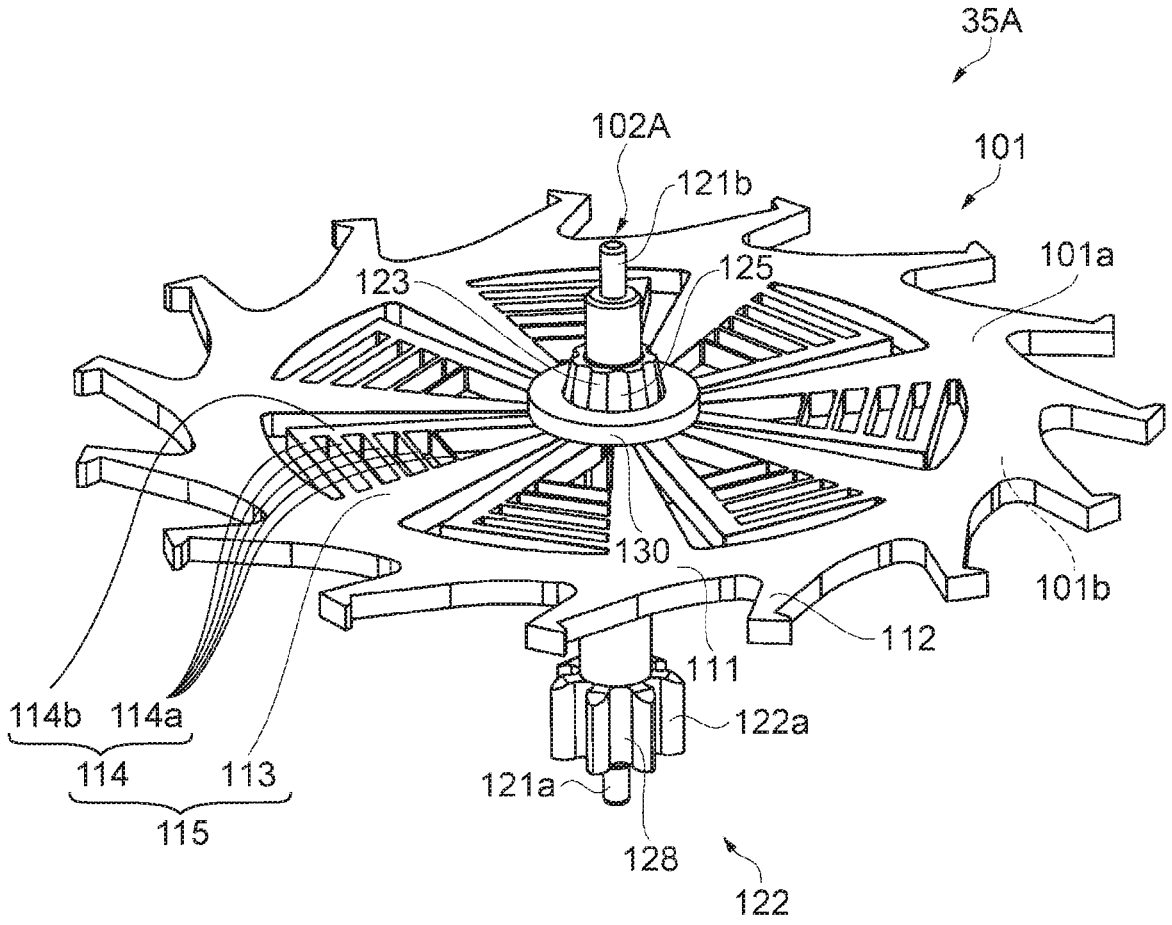
FIG. 8 is a perspective view when an escape wheel & pinion serving as a mechanical component according to Embodiment 2 is viewed from a front surface side.
Figure 9:
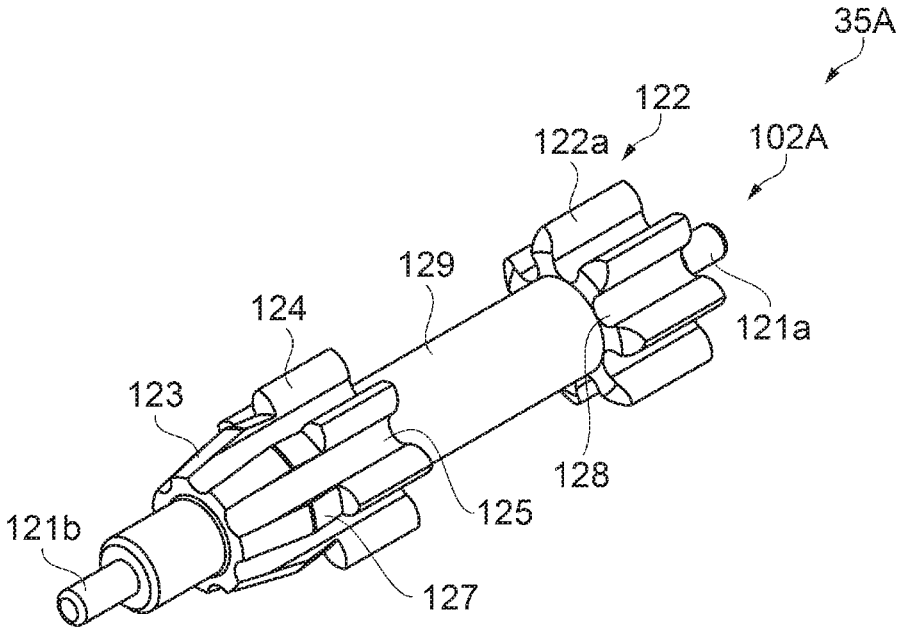
FIG. 9 is a perspective view of an axle member of the escape wheel & pinion serving as the mechanical component according to Embodiment 2.

A configuration of an escape wheel & pinion 35A according to Embodiment 2 will be described. FIG. 8 is a perspective view when the escape wheel & pinion serving as the mechanical component according to Embodiment 2 is viewed from the front surface side. FIG. 9 is a perspective view of an axle member of the escape wheel & pinion serving as the mechanical component according to Embodiment 2. Here, the points different from those of the escape wheel & pinion 35 according to Embodiment 1 will be described. The same reference numerals will be given to configuration elements the same as those according to Embodiment 1, and description thereof will be omitted.

As illustrated in FIG. 8, the escape wheel & pinion 35A serving as the mechanical component according to Embodiment 2 includes the escape wheel 101 serving as the rotary member, an axle member 102A, and a fixing member 130 (retainer). The escape wheel & pinion 35A according to Embodiment 2 is different from the escape wheel & pinion 35 according to Embodiment 1 in that the recessed portion 126 is not formed in the axle member 102A (refer to FIG. 9), and in that the escape wheel & pinion 35A includes the fixing member 130. The fixing member 130 is an annular member formed of metal or the like. The fixing member 130 has a function to fix the escape wheel 101 to the axle member 102A by performing caulking on the first tapered portion 123 of the axle member 102A.

As illustrated in FIG. 9, the axle member 102A has the tenon portions 121*a* and 121*b*, the escape pinion portion 122 serving as the wheel, the first tapered portion 123, and the protruding portion 124. Between the first tapered portion 123 and the protruding portion 124, that is, at a position corresponding to the web arm 115 of the escape wheel 101, the axle member 102A has the second tapered portion 127 whose diameter decreases as the second tapered portion 127 is closer to the protruding portion 124 from the first tapered portion 123.

The spine 114*b* of the comb 114 of the escape wheel 101 comes into contact with the second tapered portion 127. In a state where the spine 114*b* is in contact with the second tapered portion 127, the axle member 102A is held at the spine 114*b* by the stress generated in such a way that a plurality of the cross beams 114*a* are bent. Accordingly, even without the fixing member 130, the escape wheel 101 can be held in the axle member 102A.

However, there is no step difference between the first tapered portion 123 and the second tapered portion 127. Accordingly, in a case where a strong external force is applied to the escape wheel & pinion 35A in the axial direction, the spine 114*b* gets over a boundary between the first tapered portion 123 and the second tapered portion 127, thereby causing a possibility that the spine 114*b* may be displaced to the first tapered portion 123 side.

Therefore, in Embodiment 2, as illustrated in FIG. 8, the escape wheel 101 is fixed to the axle member 102A by using the fixing member 130. That is, the fixing member 130 regulates the movement of the spine 114*b* to the first tapered portion 123 side. In addition, the fixing member 130 also regulates the movement of the spoke 113 fitted to the groove 125 to the tenon portion 121*b* side. In this manner, in the escape wheel & pinion 35A according to Embodiment 2, it is also possible to prevent the escape wheel 101 from being inclined or pulled out from the axle member 102.

In addition, in the axle member 102A according to Embodiment 2, the second tapered portion 127 is also formed in the portion with which the spine 114*b* comes into contact so that the diameter decreases as the second tapered portion 127 is closer to the protruding portion 124. Therefore, even in a case where the projecting portion 127*a* whose cross section projects in an arc shape is present in the corner portion formed with the side end surface of the protruding portion 124, the interference is mitigated between the corner portion 114*c* of the distal end of the spine 114*b* and the projecting portion 127*a*. Accordingly, the spine 114*b* can be brought into contact with the protruding portion 124.

In the escape wheel & pinion 35A including the axle member 102A according to Embodiment 2, instead of a configuration including the fixing member 130, a configuration may be adopted in which the escape wheel & pinion 35A is fixed to the axle member 102A via an adhesive.

The above-described embodiments merely show one aspect of the invention, and can be optionally modified and applied within the scope of the invention. For example, as a modification example, the following configurations are conceivable.

Modification Example 1

In the above-described embodiments, configuration has been described in which the number of the web arms 115 (the spoke 113 and the comb 114) belonging to the escape wheel 101 is the same as the number of the teeth 122*a* (in the above-described embodiments, seven) of the escape pinion portion 122. However, the invention is not limited thereto. Even if a configuration is adopted in which the number of the web arms 115 is smaller than the number of the teeth 122*a* (that is, the number of the grooves 125) of the escape pinion portion 122, a similar advantageous effect can be obtained. However, in this case, it is assumed that the spoke 113 is placed at a position where the spoke 113 can be fitted to the groove 125 in the circumferential direction.

In addition, a configuration may be adopted in which the number of the web arms 115 is smaller than the number of the teeth 122*a* of the escape pinion portion 122, and in which the number of the grooves 125 is smaller than the number of the teeth 122*a* of the escape pinion portion 122. In this case, the groove 125 is formed at a step different from the step of forming the escape pinion portion 122.

Modification Example 2

In the above-described embodiments, as an example of the mechanical component, the escape wheel & pinion has been described. However, the invention is not limited thereto. The configuration and the manufacturing method of the mechanical component according to the invention can also be applied to other mechanical components such as the movement barrel 22, the center wheel & pinion 25, the third wheel & pinion 26, the second wheel & pinion 27, the pallet fork 36, and the balance with hairspring 40.

The entire disclosure of Japanese Patent Application No. 2017-089387 filed Apr. 28, 2017 is expressly incorporated by reference herein.

What is claimed is:

1. A mechanical component for a timepiece comprising:
an axle; and
a rotary member that has a web arm which engages the axle, and a rim which has a plurality of teeth,
wherein the web arm has a spoke which radially extends from the rim and a comb which branches from the spoke,
the spoke extends in a radial direction from the rim toward the axle, and
the comb has a cross beam which extends in a direction intersecting the spoke.

2. The mechanical component for a timepiece according to claim 1,
wherein the comb has a spine which extends in the radial direction from the cross beam toward the axle.

3. The mechanical component for a timepiece according to claim 1,
wherein the comb has a plurality of the cross beams.

4. The mechanical component for a timepiece according to claim 1,
wherein the spoke, the comb, and the rim are monolithic.

5. The mechanical component for a timepiece according to claim 1,
wherein the axle has a groove fitted to the spoke.

6. The mechanical component for a timepiece according to claim 5,
wherein the axle has a wheel including a plurality of circumferentially spaced apart and axially elongated teeth, and
an interval between adjacent ones of the teeth is equal to a width of the groove.

7. The mechanical component for a timepiece according to claim 6,
wherein the axle has a first tapered portion having a diameter that decreases away from the web arm, the first tapered portion being on an opposite of the web arm as the wheel.

8. The mechanical component for a timepiece according to claim 7,
wherein the axle has a protruding portion which protrudes outward with respect to the web arm on the wheel side, and which contacts a surface of the comb on the wheel side, and
wherein the axle has a second tapered portion between the protruding portion and the first tapered portion, and a diameter of the second tapered portion decreases toward the protruding portion.

9. The mechanical component for a timepiece according to claim 8,
wherein the axle has a recessed portion fitted to the comb, the recessed portion being located between the protruding portion and the first tapered portion, and
wherein the second tapered portion is a wall of the recessed portion.

10. The mechanical component for a timepiece according to claim 1,
wherein the rotary member is fixed to the axle via an adhesive.

11. The mechanical component for a timepiece according to claim 1, further comprising:
an annular fixing member that fixes the rotary member to the axle.

12. A timepiece comprising:
an axle;
a rotary member that has a web arm which engages the axle, the rotary member having a rim which has a plurality of teeth; and
a movement barrel operatively associated with the axle and the rotary member,
wherein the web arm has a spoke which radially extends from the rim and a comb which branches from the spoke,
the spoke extends in a radial direction from the rim toward the axle, and
the comb has a cross beam which extends in a direction intersecting the spoke.

13. A mechanical component for a timepiece comprising:
an axle; and
a monolithic gear wheel including:
a plurality of radial web arms engaging the axle at a plurality of discrete circumferential locations, and
an annular rim encircling the web arms, the rim having a plurality of gear teeth extending therefrom,
wherein each web arm includes:
a spoke radially extending from a proximal end at the rim to a distal end at the axle;
a plurality of laterally spaced apart cross beams extending from first ends at the spoke in a direction substantially parallel to a tangent of the rim, and
a spine radially extending from second ends of the cross beams to the axle, a proximal end of the spine being radially spaced apart from the rim.

14. The mechanical component for a timepiece according to claim 13,
wherein the axle has a plurality of circumferentially spaced apart axially elongated grooves, and the distal ends of the spokes are respectively nested within the grooves.

15. The mechanical component for a timepiece according to claim 14,
wherein the grooves have substantially the same width,
wherein the axle has a pinion including a plurality of circumferentially spaced apart axially elongated teeth, and
an interval between adjacent pairs of the teeth is equal to the width of the grooves.

16. The mechanical component for sa timepiece according to claim 15, wherein the axle includes:
a plurality of circumferentially spaced apart axially elongated flutes that taper away from the pinion, each flute having a lip configured to respectively abut a first surface of the spines,
a plurality of circumferentially spaced apart radially protruding stops configured to respectively abut a second surface of the spines, the stops being provided in one-to-one correspondence with the flutes, and
an axially elongated notch between each of the flutes and a corresponding one of the stops, each notch having a tapered base wall that tapers toward the stops.

17. The mechanical component for a timepiece according to claim 13, wherein the axle includes:
a plurality of circumferentially spaced apart axially elongated flutes that taper in a first axial direction of the axle, each flute having a lip configured to respectively abut a first surface of the spines,
a plurality of circumferentially spaced apart radially protruding stops configured to respectively abut a second surface of the spines, the stops being provided in one-to-one correspondence with the flutes, and an axially elongated notch between each of the flutes and a corresponding one of the stops, each notch having a tapered bottom wall that tapers in a second axial direction of the axle, the second axial direction being opposite to the first axial direction.

18. The mechanical component for a timepiece according to claim 13, wherein the gear wheel is fixed to the axle via an adhesive.

19. The mechanical component for a timepiece according to claim 13, further comprising:

an annular retainer fixing the gear wheel to the axle.

20. A timepiece comprising:

the mechanical component according to claim 13; and a movement barrel operatively associated with the mechanical component.

21. The mechanical component for a timepiece according to claim 1, wherein the rotary member contains silicon.

22. The mechanical component for a timepiece according to claim 13, wherein the rotary member contains silicon.

23. The mechanical component for a timepiece according to claim 5, further comprising:

a spine that extends in the radial direction from the cross beam toward the axle and comes in contact with the axle, wherein the spoke has a distal end being located toward a center side of the axle than a distal end of the spine in a plan view when viewed in an axial direction of the axle.

24. The mechanical component for a timepiece according to claim 23, wherein, when the spoke is fitted into the groove of the axle, the distal end of the spoke is spaced apart from the groove of the axle by a gap.

* * * * *